US008282779B2

(12) United States Patent
Trani et al.

(10) Patent No.: US 8,282,779 B2
(45) Date of Patent: Oct. 9, 2012

(54) METHOD FOR FORMING WEBS OF TRANSVERSELY EXTENSIBLE FIBROUS MATERIAL, IN PARTICULAR PAPER, AND APPARATUS FOR IMPLEMENTING THE METHOD

(75) Inventors: Giorgio Trani, Venice (IT); Marion Sterner, Venice (IT)

(73) Assignee: Giorgio Trani, Venice (IT)

( * ) Notice: Subject to any disclaimer, the term of this patent is extended or adjusted under 35 U.S.C. 154(b) by 69 days.

(21) Appl. No.: 13/056,000

(22) PCT Filed: Aug. 4, 2009

(86) PCT No.: PCT/EP2009/060065

§ 371 (c)(1), (2), (4) Date: Jan. 26, 2011

(87) PCT Pub. No.: WO2010/015614

PCT Pub. Date: Feb. 11, 2010

(65) Prior Publication Data

US 2011/0126997 A1 Jun. 2, 2011

(30) Foreign Application Priority Data

Aug. 7, 2008 (IT) ..... VE2008A0066

(51) Int. Cl.
*D21F 11/00* (2006.01)

(52) U.S. Cl. ..... 162/202; 162/361

(58) Field of Classification Search ..... 162/202, 162/361

See application file for complete search history.

(56) References Cited

U.S. PATENT DOCUMENTS 1,643,147 A 9/1927 Angier
2,535,734 A 12/1950 Grettve

FOREIGN PATENT DOCUMENTS

GB 1194252 6/1970

*Primary Examiner* — Mark Halpern
(74) *Attorney, Agent, or Firm* — Themis Law

(57) ABSTRACT

A method for producing webs of transversely extensible fibrous material, in particular paper, characterised by causing a web (12) of pliable fibrous material having a water content between 20% and 80% to adhere to at least one continuous elastic band elastic (6, 26, 31, 46, 66) adhering to the lateral surface of a first rotating roller, provided on its lateral surface with at least one circumferential cavity and to temporarily and locally pre-stretched said band by making it to enter into said at least one cavity for interference from at least one second rotating roller having its axis parallel to the axis of the first roller.

20 Claims, 4 Drawing Sheets

FIG. 6
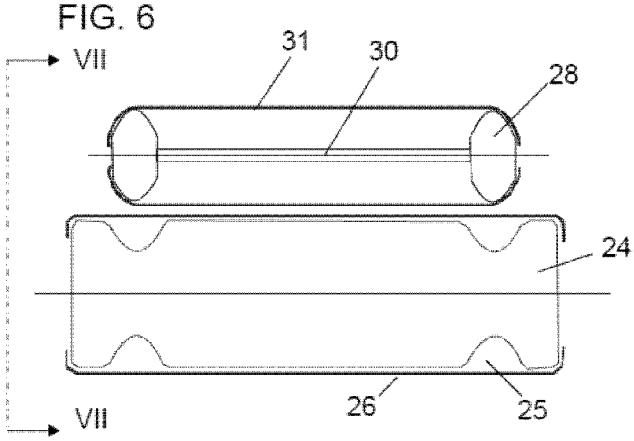
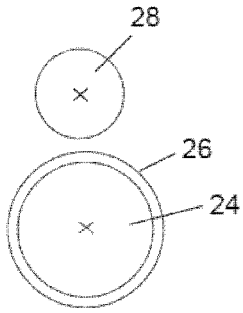
FIG. 7
FIG. 8
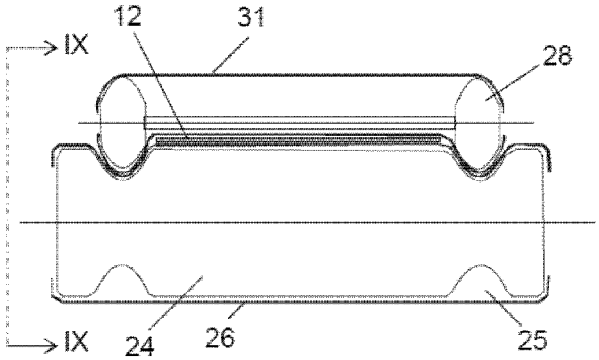
FIG. 9
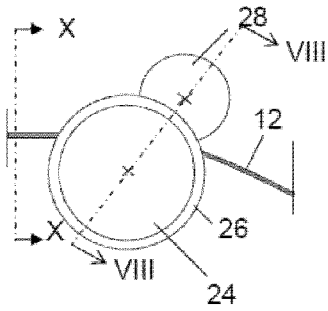
FIG. 10
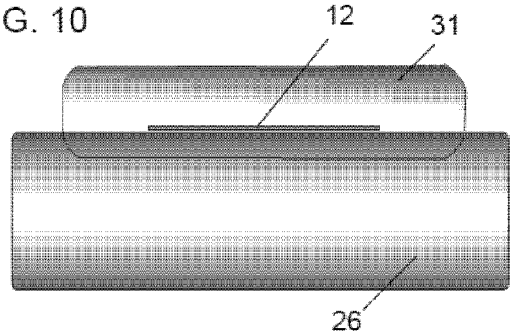

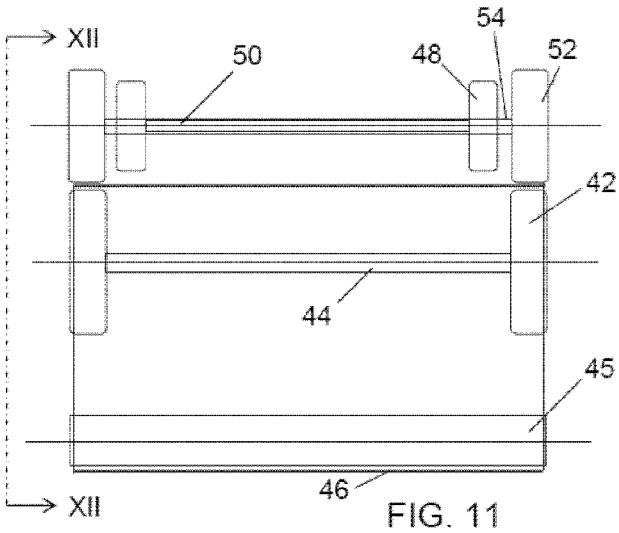
FIG. 11
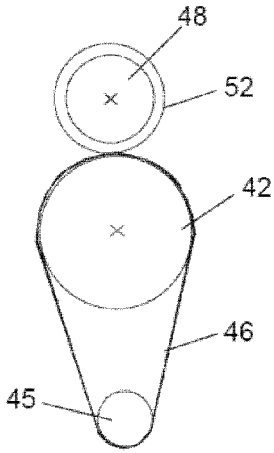
FIG. 12
FIG. 13
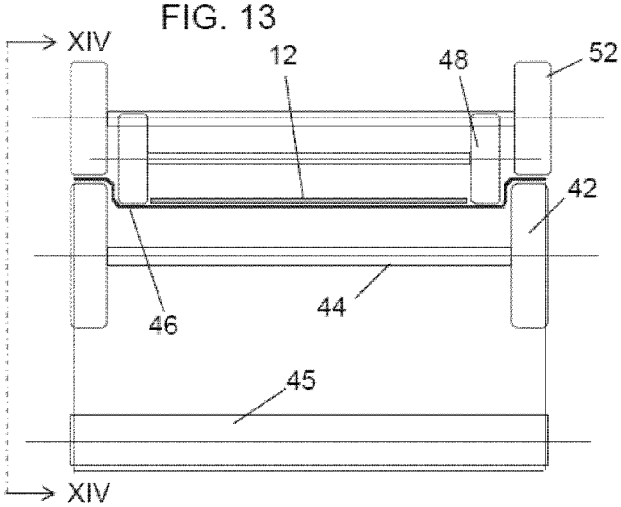
FIG. 14
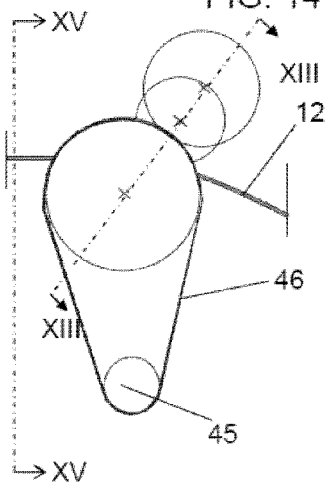
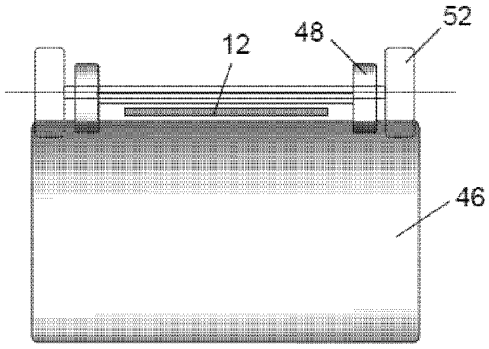
FIG. 15

METHOD FOR FORMING WEBS OF TRANSVERSELY EXTENSIBLE FIBROUS MATERIAL, IN PARTICULAR PAPER, AND APPARATUS FOR IMPLEMENTING THE METHOD

This application is a 371 of PCT/EP09/060065 filed Aug. 4, 2009

The present invention relates to a method for forming webs of transversely extensible fibrous material, in particular paper, and an apparatus for implementing the method.

Methods for forming transversely extensible paper webs are known. They are generally combined with methods for forming paper webs which are also longitudinally extensible and consequently enable paper webs to be formed which are extensible in all directions.

In one of these known methods, described in U.S. Pat. No. 2,624,245, a paper web having a suitable moisture content is made to adhere to an endless band undergoing contraction. This method is widely used and enables high production rates to be achieved. However, the degree of extensibility in the transverse direction, i.e. in a direction perpendicular to the advancement direction of the paper web within the paper machine, is rather limited (not exceeding 5%), whereas the degree of extensibility in the longitudinal direction is much higher.

An object of the present invention is to propose a method and apparatus which allow high rate production of webs of fibrous material, in particular paper, able to be extended transversely to a greater degree than in the past.

This and other objects which will be apparent from the ensuing description are attained according to the invention by a production method for webs of extensible fibrous material, as described in claim 1.

To implement this method the invention uses different apparatuses, specifically comprising at least one band of elastic material, which before receiving the paper web under formation is stretched transversely and, after having received it, is released to reassume its initial configuration, this resulting in a transverse accumulation of the web fibres and their consequent potentiality to undergo transverse extension.

During this process the paper web under formation can also be subjected to longitudinal accumulation of the fibres, such that the final web possesses extensibility characteristics both in the longitudinal and in the transverse direction.

Figure 1:
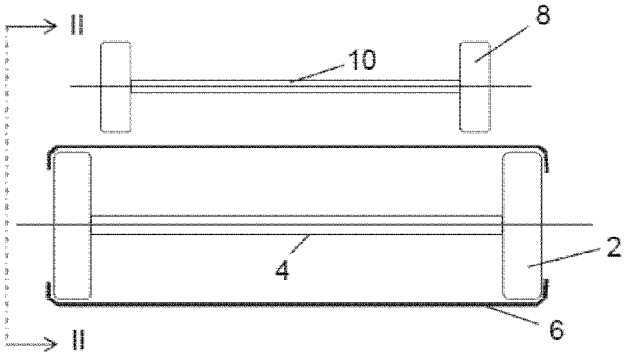
Figure 2:
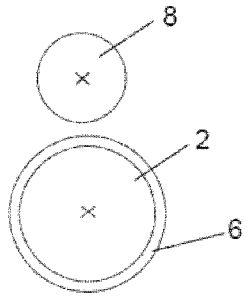
Figure 3:
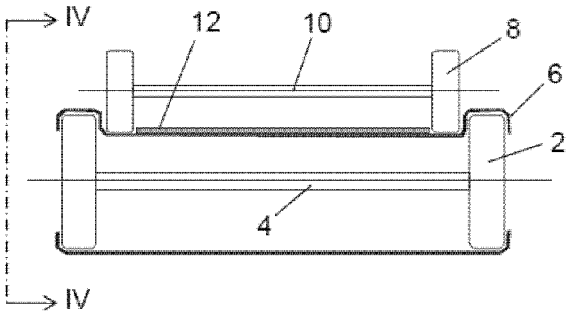
Figure 4:
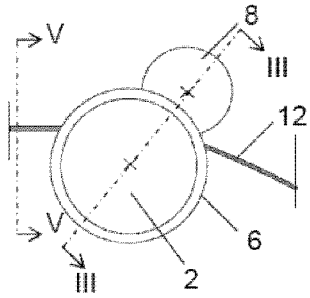
Figure 5:
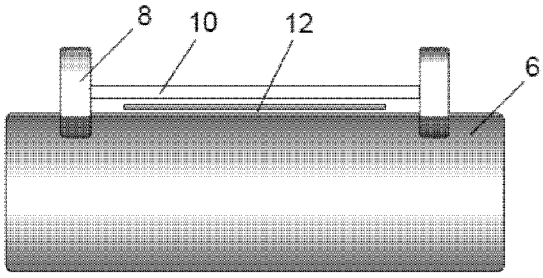
Figure 16:
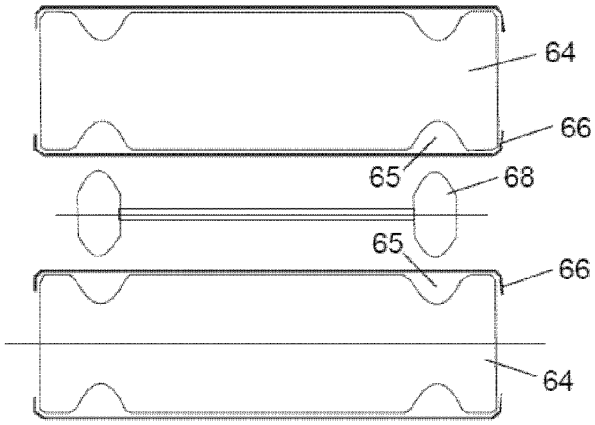

The present invention is further clarified hereinafter in terms of some preferred embodiments described, with reference to the accompanying drawings, in which:

FIG. 1 is a schematic view of an apparatus for implementing the method of the invention, shown in the rest condition, FIG. 2 is a side view thereof on the line II-II of FIG. 1, FIG. 3 shows it in the operative condition, seen on the line III-III of FIG. 4, FIG. 4 is a side view thereof on the line IV-IV of FIG. 3, FIG. 5 is a view thereof on the line V-V of FIG. 3, seen from the side on which the paper web leaves, FIG. 6 is a schematic view of a second embodiment of an apparatus for implementing the method of the invention, shown in the rest condition, FIG. 7 is a view thereof on the line VI-VI of FIG. 6, FIG. 8 shows it in the operative condition, seen on the line VIII-VIII of FIG. 9, FIG. 9 is a view thereof on the line IX-IX of FIG. 8, FIG. 10 is a view thereof on the line X-X of FIG. 9, seen from the side on which the paper web leaves, FIG. 11 is a schematic view of a third embodiment of an apparatus for implementing the method of the invention, shown in the rest condition, FIG. 12 is a view thereof on the line XII-XII of FIG. 11, FIG. 13 shows it in the operative condition, seen on the line XIII-XIII of FIG. 14, FIG. 14 is a view thereof on the line XIV-XIV of FIG. 13, FIG. 15 is a view thereof on the line XV-XV of FIG. 14, seen from the side on which the paper web leaves, FIG. 16 shows a different embodiment of the apparatus for implementing the method of the invention.

Figure 17:
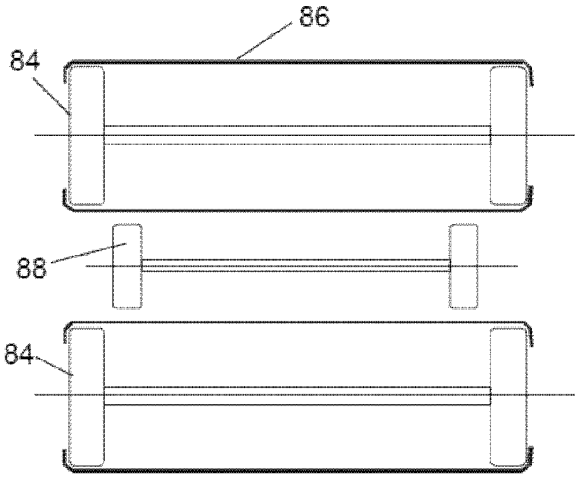
Figure 18:
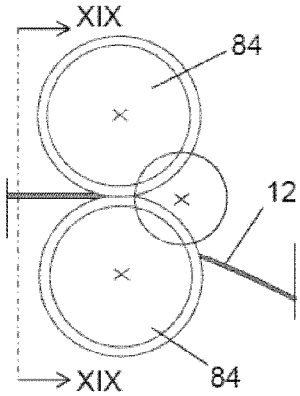
Figure 19:
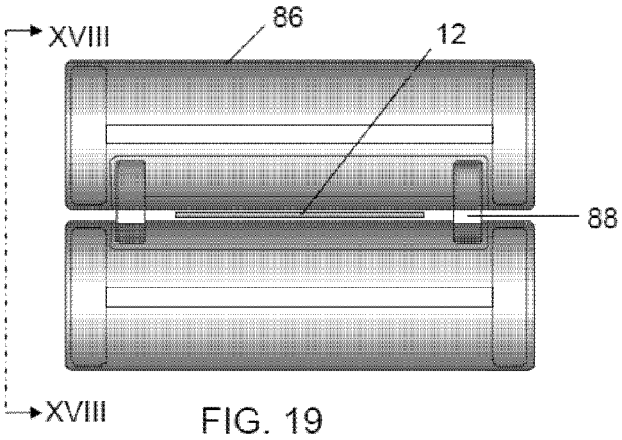

FIGS. 17-19 show the embodiment of FIG. 16, with the difference that instead of using two grooved rollers, two pairs of rollers are used each provided with an elastic sleeve.

As can be seen from FIGS. 1-5, the method of the invention uses an apparatus basically comprising a pair of rollers 2 mounted on a single shaft 4 which rotates them by any suitable means, not shown in the drawings.

A single sleeve 6 of elastic material is applied to the two rollers 2 to completely cover the space defined by these and is stabilized in its position by folding its end edges over the ends of the two rollers 2. This stabilization can be achieved in various ways, for example by locking said edges against the respective rollers 2 using annular flanges, or by securing the edges to an inextensible ring, which prevents them from opening.

Associated with the pair of rollers 2 there is a second pair of rollers 8 mounted on a single shaft 10 driven with rotary movement about its axis, and with translational movement causing it to approach and withdraw from the shaft 4 of the rollers 2 between a position of non-interference shown in FIG. 1, and a position of interference shown in FIG. 3.

When under interference conditions the sleeve 6 evidently deforms in the sense of elongating transversely, as apparent in FIG. 3.

The rotation velocity $\omega_1$ of the rollers 8 is chosen on the basis of the rotation velocity $\omega_2$ of the rollers 2, such that the peripheral velocity of said rollers 8 is equal to the peripheral velocity of the sleeve 6 at the point of maximum interference.

If $r_1$ is the radius of the rollers 8 rotating at a velocity $\omega_1$, $r_2$ is the radius of the rollers 2 rotating at a velocity $\omega_2$ and d is the interference between the rollers 4 and 6, the relationship between the roller velocity $\omega_1$ and $\omega_2$ is such that $$\omega_2 r_2 = \omega_1 (r_1 - d)$$

When however the sleeve 6 has overcome the interference region and is no longer subjected to extension by the rollers 8, it returns elastically into its original configuration.

If the two pairs of mutually interfering rollers 4 and 8 are positioned at the exit of a forming line of a paper web 12 which is still pliable, i.e. with a moisture content between 20% and 80%, preferably between 40% and 60%, it rests on the pre-stretched portion of sleeve 6, but when this returns to its original configuration it causes the web to undergo transverse contraction and produce a potentiality for transverse extension which is greater the greater its degree of contraction, i.e. the degree of pre-extension of the sleeve 6 on which it had been rested. Normally, the greater the interference between the rollers 2 and 8, the greater is the elongation of the elastic sleeve and hence the greater the extent of transverse accumulation of the web fibres, and the greater the degree of extensibility of the web obtained.

According to the invention the paper web 12 to be subjected to treatment does not need to originate directly from a forming line and to have by virtue of its nature a moisture content between 20% and 80%, but instead can be already perfectly formed and dried. In this case, according to the process of the invention, it is initially subjected to wetting treatment (bath, spray, vaporization, etc.) which makes it absorb the water quantity required to give it pliability similar to a web leaving a paper forming line.

FIGS. 6-10 schematically show a different embodiment of an apparatus for implementing the method of the invention. It comprises a roller 24 provided in proximity to its ends with a pair of circumferential grooves 25 and covered with a rubber sleeve 26 substantially identical to the sleeve 6 of the preceding embodiment.

The apparatus also comprises a pair of rollers 28 mounted on a shaft 30 and having a profile complementary to the profile of the grooves 25.

The unit formed by the two rollers 28 and their shaft 30 is covered by a second elastic sleeve 31 and is also driven both with rotary movement about the axis of the shaft 10 and with translational movement in the sense of causing it to approach and withdraw from the roller 24, between a position of non-interference shown in FIG. 6, and a position of interference shown in FIG. 8. When in this interference position the co-penetration of the rollers 28 into the grooves 25 of the roller 24 and the simultaneous co-penetration of the central part of the roller 24, bounded by the grooves 25, into the space bounded by the two rollers 28, causes a virtually identical transverse elongation of the two sleeves 26 and 31, which remain in contact within the parts bounding the space intended to receive the paper web 12 under formation.

This embodiment of the apparatus enables the method of the invention to be implemented by retaining the paper web 12 under formation not its simple resting on just the lower sleeve 26, but by clamping it between the lower sleeve 26 and the upper sleeve FIGS. 11-15 show schematically a third embodiment of an apparatus for implementing the method of the invention.

It comprises a pair of rollers 42 mounted on a single shaft 44 and rotated thereby in known manner. An endless band 46 of elastic material extends between these rollers 42 and a return roller 45.

Associated with the pair of rollers 42 there is a first pair of rollers 52, mounted on a shaft 54 and adhering with its lateral surface to the lateral surface of the rollers 42, to retain the interposed edge of the endless band 46. There is also associated with the pair of rollers 42 a second pair of rollers 48 mounted on a shaft 50. The unit formed by the rollers 48 and shaft 50 is also driven both with rotary movement about its axis and with translational movement in the sense of causing it to approach and withdraw from the shaft 44, between a position of non-interference shown in FIG. 11, and a position of interference shown in FIG. 13.

The difference between his third embodiment and the first embodiment shown in FIGS. 1-5 consists essentially of the different form of the elastic sleeve, which in the case of the first embodiment is tubular and simply wraps the rollers 2, whereas in the case of the third embodiment it consists of an endless band 46 which has to be retained along its edges against the rollers 42 as the rollers 48 extend it transversely, and hence requires the rollers 52.

FIG. 16 shows a different embodiment of the apparatus for implementing the method of the invention. It uses two identical grooved rollers 64, both covered with an elastic sleeve 66, and a pair of rollers 68 having their profile complementary to the grooves 65 provided in the two rollers 64.

In this case, when the two rollers 64 are made to approach each other into their working condition and the rollers 68 are made to enter the grooves 65 of the rollers 64, they cause the two sleeves 66 to stretch transversely so that in that part between the grooves 65 they mutually adhere to clamp the interposed paper web 12 under formation.

The embodiment shown in FIGS. 17-19 corresponds substantially to that shown in FIG. 16, but with the difference that instead of using two grooved rollers, two pairs of rollers 84 are used each provided with an elastic sleeve 86. When in the rest condition (FIG. 17), the two pairs of rollers 84 are spaced apart and spaced from a third pair of rollers 88, these being spaced apart by a smaller distance than the two rollers 84 of each pair. When under working conditions, the two pairs of rollers 84 are made to approach each other such that the respective elastic sleeves 86 adhere against the interposed paper web 12 under formation. Again when under working conditions, the two rollers 88 are also made to approach the two pairs of rollers 84, such as to interfere with the rollers and cause localized temporary stretching of the two sleeves 86.

It will be apparent that independently of the apparatus embodiment used to implement the method of the invention, this allows the formation, at high production rate, of a paper web which is transversely extensible to a degree which is greater the greater the extent of transverse pre-stretch of that or those surfaces which adhere to the paper web under formation.

The invention also enables the aforedescribed process to be associated with (by preceding or following) one of the known systems for also achieving high elongation in the longitudinal direction.

The material used for the elastic sleeve can be single or multilayer natural and/or synthetic rubbers, such as nitrile butadiene rubber (NBR), hydrated nitrile butadiene rubber (HNBR), chlorosulfonated polyethylene rubber (CSM), natural rubber, styrenebutadiene rubber (SBR), ethylene-propylene-diene rubber (EPDM), chlorophenyl rubber (CR), neoprene, nylon, polyurethane or silicone elastomers, possibly filled to ensure lengthy absence of relaxation and resistance to cracking.

What is claimed is:

1. A method for producing webs of transversely extensible fibrous material, in particular paper, comprising:

causing a web of pliable fibrous material having a water content between 20% and 80% to adhere to at least one continuous elastic band adhering to a lateral surface of a first rotating roller, provided on its lateral surface with at least one circumferential cavity; and causing said band to become temporarily and locally pre-stretched by making it enter into said at least one cavity for interference from at least one second rotating roller having its axis parallel to the axis of the first roller.

2. The method as claimed in claim 1, further comprising using a web of fibrous material having a water content between 40% and 60%.

3. The method as claimed in claim 1, further comprising using, as a continuous band, a sleeve wrapping said first roller.

4. The method as claimed in claim 1, wherein said continuous band is countered by said first roller.

5. The method as claimed in claim 3, further comprising pre-stretching said band to mechanically deform it, while being retained along its longitudinal edges.

6. The method as claimed in claim 1, further comprising maintaining said paper web under formation adhering to said elastic surface by simple resting.

7. The method as claimed in claim 1, further comprising maintaining said paper web under formation adhering to a pair of elastic surfaces, between which said web is interposed.

8. The method as claimed in claim 1, further comprising using a web of pliable fibrous material directly originating from a processing line which already brings it to a moisture content between 20% and 80%.

9. The method as claimed in claim 1, further comprising using a web of fibrous material which is already stabilized in terms of its moisture content and is subjected to drying treatment which brings its moisture content to 20%-80%.

10. The method as claimed in claim 1, wherein the method is associated with a method for producing longitudinally extensible webs.

11. An apparatus for producing webs of transversely extensible fibrous material starting from a web having a moisture content between 20% and 80%, comprising:

an endless band of elastic material wrapping a first rollered member provided with at least two outer rollers, with at least one circumferential cavity delimited by said two outer rollers, and with means for securing the longitudinal edges of said endless band to said outer rollers; and a second rollered member brought into interference with said first rollered member to cause that surface of said band not secured to said outer rollers to enter said cavity.

12. The apparatus as claimed in claim 11, wherein said endless band comprises a sleeve wrapping said first rollered member.

13. The apparatus as claimed in claim 12, wherein said sleeve is maintained secured to the outer rollers of said first rollered member by folding over its edges and by stabilizing the folded edges.

14. The apparatus as claimed in claim 13, wherein an inextensible ring is associated with the edges of the sleeve wrapping said first rollered member and stabilized against the outer rollers by bending over said edges.

15. The apparatus as claimed in claim 13, wherein flanges form clamping said edges and cooperating with said outer rollers are associated with the edges of the sleeve wrapping said first rollered member and stabilized against the outer rollers by bending over said edges.

16. The apparatus as claimed in claim 11, wherein said second rollered member consists of a pair of rollers mounted on a shaft at a distance apart less than the distance between the outer rollers of said first rollered member and is translatable relative thereto between a position of non-interference and a position of interference.

17. The apparatus as claimed in claim 11, wherein said first rollered member comprises a roller having two circumferential grooves in proximity to its two ends and wrapped by the elastic sleeve, said second rollered member comprising a pair of rollers having a profile complementary to said circumferential grooves and mounted on a shaft at a distance apart equal to the distance between said grooves.

18. The apparatus as claimed in claim 11, wherein said first rollered member comprises:

a pair of rollers mounted spaced apart on a shaft;

a return roller disposed parallel to said shaft; and an endless band of elastic material passing between said rollers and said return roller 3, said second rollered member comprising a first pair of rollers interacting with the rollers of the first rollered member to locally retain the interposed portions of said endless band by clamping, and a second pair of rollers mounted on a shaft at a distance apart less than the distance between the rollers of the first rollered member and movable with said shaft between a position of interference and a position of non-interference with said rollers of the first rollered member.

19. The apparatus as claimed in claim 11, wherein said second rollered member comprises an elastic sleeve which wraps the rollers.

20. The apparatus as claimed in claim 11, wherein said first rollered member comprises two separate equal rollers each provided in proximity to its ends with continuous circumferential grooves and wrapped by a respective elastic sleeve, said second rollered member comprising a pair of rollers having a profile complementary to the profile of said grooves and spaced apart by a distance equal to the distance between these latter, said first and second rollered member being movable between a rest position in which the two elastic sleeves of the two equal rollers are spaced apart and the rollers of the second rollered member do not interfere with said grooves, and a working position in which said elastic sleeves are in mutual contact and retain the interposed paper web under formation, with the rollers of the second rollered member interfering with said grooves.

* * * * *